US012606953B2

(12) United States Patent
Tetsui et al.

(10) Patent No.: US 12,606,953 B2
(45) Date of Patent: Apr. 21, 2026

(54) URETHANE RESIN AQUEOUS DISPERSION, SYNTHETIC LEATHER, AND METHOD FOR PRODUCING SYNTHETIC LEATHER

(71) Applicant: DIC Corporation, Tokyo (JP)

(72) Inventors: Tomohiro Tetsui, Takaishi (JP); Ryo Maeda, Takaishi (JP); Yayi Tseng, Takaishi (JP)

(73) Assignee: DIC Corporation, Tokyo (JP)

( * ) Notice: Subject to any disclaimer, the term of this patent is extended or adjusted under 35 U.S.C. 154(b) by 826 days.

(21) Appl. No.: 17/787,414

(22) PCT Filed: Oct. 15, 2020

(86) PCT No.: PCT/JP2020/038848

§ 371 (c)(1),
(2) Date: Jun. 20, 2022

(87) PCT Pub. No.: WO2021/124661

PCT Pub. Date: Jun. 24, 2021

(65) Prior Publication Data

US 2023/0026604 A1 Jan. 26, 2023

(30) Foreign Application Priority Data

Dec. 20, 2019 (JP) ..... 2019-230244

(51) Int. Cl.

| | |
|---|---|
| ***B32B 27/40*** | (2006.01) |
| ***C08L 75/04*** | (2006.01) |
| ***C09D 175/04*** | (2006.01) |
| ***C09J 175/04*** | (2006.01) |
| ***D06N 3/14*** | (2006.01) |

(52) U.S. Cl.

CPC ..... *D06N 3/141* (2013.01); *D06N 2203/068* (2013.01); *D06N 2205/023* (2013.01); *D06N 2211/28* (2013.01)

(58) Field of Classification Search

None

See application file for complete search history.

(56) References Cited

U.S. PATENT DOCUMENTS

| | | | | |
|---|---|---|---|---|
| 2018/0030650 | A1* | 2/2018 | Tetsui | C09D 5/00 |
| 2020/0071452 | A1 | 3/2020 | Maeda | |
| 2020/0263352 | A1 | 8/2020 | Maeda | |
| 2021/0230799 | A1 | 7/2021 | Maeda et al. | |

FOREIGN PATENT DOCUMENTS

| | | | |
|---|---|---|---|
| EP | 3266930 | A1 | 1/2018 |
| JP | H11-293220 | A | 10/1999 |
| WO | 2018/110105 | A1 | 6/2018 |
| WO | 2019/058692 | A1 | 3/2019 |
| WO | 2019/235125 | A1 | 12/2019 |

* cited by examiner

*Primary Examiner* — Michael J Feely

(74) *Attorney, Agent, or Firm* — Troutman Pepper Locke LLP; James E. Armstrong, IV

(57) ABSTRACT

A task to be achieved by the present invention is to provide a urethane water dispersion which is unlikely to soak the substrate well, and which has excellent peel strength and excellent prompt releasability. The present invention provides a urethane resin water dispersion containing a urethane resin (A), water (B), and a crosslinking agent (C), wherein the urethane resin (A) has a viscosity at 50° C. in the range of from 15,000 to 34,000 mPa·s, a viscosity at 100° C. in the range of from 1,000 to 10,000 mPa·s, and a viscosity at 150° C. in the range of from 100 to 1,300 mPa·s. Further, the present invention provides a synthetic leather having a bonding layer formed from the urethane resin water dispersion. Further, the present invention provides a method for producing the synthetic leather.

6 Claims, No Drawings

URETHANE RESIN AQUEOUS DISPERSION, SYNTHETIC LEATHER, AND METHOD FOR PRODUCING SYNTHETIC LEATHER

TECHNICAL FIELD

The present invention relates to a urethane resin water dispersion, a synthetic leather, and a method for producing a synthetic leather.

BACKGROUND ART

Conventionally, with respect to a polyurethane resin composition, mainly a solvent urethane resin composition has been used in a variety of applications, for example, synthetic leather (including artificial leather), a coating agent, a film for gloves, and an adhesive.

With respect to the above-mentioned adhesive, for example, a one-pack wet lamination adhesive, a two-pack dry lamination adhesive, a one-pack hot-melt adhesive, a solventless two-pack adhesive, a hot-melt resin film, and the like have been known (see, for example, PTL 1). Among these, a two-pack dry lamination adhesive having incorporated a urethane resin base material and a crosslinking agent is widely used because it has excellent processability and excellent durability after cured.

The two-pack dry lamination adhesive is advantageous in that application of the adhesive and control of the amount of the adhesive that soaks the substrate are easy; however, the two-pack dry lamination adhesive needs the aging step for a period of time as long as 48 hours after lamination, and thus has a drawback in view of the production efficiency. Further, when winding the final product of the processing line facilities, the adhesive is not yet cured, and therefore the product must be wound together with release paper as a support for the product for preventing the skin and the substrate from separating. In this instance, it is necessary to cut the release paper for each production lot, and the release paper cannot be reused, and hence the two-pack dry lamination adhesive has a disadvantage from the viewpoint of the cost.

CITATION LIST

Patent Literature

PTL 1: JP-A-11-293220

SUMMARY OF INVENTION

Technical Problem

A task to be achieved by the present invention is to provide a urethane water dispersion which is unlikely to soak the substrate well, and which has excellent peel strength and excellent prompt releasability.

Solution to Problem

The present invention provides a urethane resin water dispersion containing a urethane resin (A), water (B), and a crosslinking agent (C), wherein the urethane resin (A) has a viscosity at 50° C. in the range of from 15,000 to 34,000 mPa·s, a viscosity at 100° C. in the range of from 1,000 to 10,000 mPa·s, and a viscosity at 150° C. in the range of from 100 to 1,300 mPa·s.

Further, the invention provides a synthetic leather having a bonding layer formed from the above-mentioned urethane resin water dispersion. Further, the invention provides a method for producing the synthetic leather.

Advantageous Effects of Invention

The urethane resin water dispersion of the present invention contains water and is environment-friendly. Further, the urethane resin water dispersion is unlikely to soak the substrate well and has excellent peel strength and excellent prompt releasability.

DESCRIPTION OF EMBODIMENTS

The urethane resin water dispersion of the present invention contains a urethane resin (A), water (B), and a crosslinking agent (C), wherein the urethane resin (A) has a viscosity at 50° C. in the range of from 15,000 to 34,000 mPa·s, a viscosity at 100° C. in the range of from 1,000 to 10,000 mPa·s, and a viscosity at 150° C. in the range of from 100 to 1,300 mPa·s.

In view of obtaining the urethane resin water dispersion which is unlikely to soak the substrate well (hereinafter, this property is referred to simply as "anti-soaking property"), and which has excellent peel strength and excellent prompt releasability, it is necessary that the urethane resin (A) has a viscosity at 50° C. in the range of from 15,000 to 34,000 mPa·s, a viscosity at 100° C. in the range of from 1,000 to 10,000 mPa·s, and a viscosity at 150° C. in the range of from 100 to 1,300 mPa·s.

Further, from the viewpoint of achieving further more excellent anti-soaking property, peel strength, and prompt releasability, it is preferred that the urethane resin (A) has a viscosity at 50° C. in the range of from 25,000 to 33,000 mPa·s, a viscosity at 100° C. in the range of from 2,000 to 7,000 mPa·s, and a viscosity at 150° C. in the range of from 150 to 1,000 mPa·s.

As an example of the method for controlling the above-mentioned three viscosity values of the urethane resin (A) to be in the respective ranges defined in the present invention, there can be mentioned a method of controlling the viscosity values mainly by the weight average molecular weight of the urethane resin (A).

The urethane resin (A) preferably has a weight average molecular weight in the range of from 65,000 to 125,000, more preferably in the range of from 80,000 to 120,000. The number average molecular weight or weight average molecular weight of the urethane resin (A) indicates a value as measured by a gel permeation chromatography (GPC) method under the below-mentioned conditions. Further, when two or more urethane resins are used as the urethane resin (A), the molecular weight of the urethane resin (A) indicates an average of the molecular weight values of the urethane resins.

The urethane resin (A) can be dispersed in the water (B), and there can be used, for example, a urethane resin having a hydrophilic group, such as an anionic group, a cationic group, or a nonionic group; or a urethane resin forcibly dispersed in the water (B) using an emulsifying agent. These urethane resins (A) may be used individually or in combination.

As a method for obtaining the urethane resin having an anionic group, for example, there can be mentioned a method using at least one compound selected from the group consisting of a compound having a carboxyl group and a compound having a sulfonyl group as a raw material.

As the compound having a carboxyl group, for example, 2,2-dimethylolpropionic acid, 2,2-dimethylolbutanoic acid, 2,2-dimethylolbutyric acid, 2,2-dimethylolpropionic acid, 2,2-valeric acid, or the like can be used. These compounds may be used individually or in combination.

As the compound having a sulfonyl group, for example, there can be used 3,4-diaminobutanesulfonic acid, 3,6-diamino-2-toluenesulfonic acid, 2,6-diaminobenzenesulfonic acid, N-(2-aminoethyl)-2-aminosulfonic acid, N-(2-aminoethyl)-2-aminoethylsulfonic acid, or the like. These compounds may be used individually or in combination.

With respect to the carboxyl group and sulfonyl group, part of or all of the carboxyl group and sulfonyl group may be neutralized by a basic compound in the urethane resin composition. As the basic compound, for example, there can be used ammonia, an organic amine, such as triethylamine, pyridine, or morpholine; an alkanolamine, such as monoethanolamine or dimethylethanolamine; or a metal basic compound containing sodium, potassium, lithium, calcium, or the like.

As a method for obtaining the urethane resin having a cationic group, for example, there can be mentioned a method using one or two or more compounds having an amino group as a raw material.

As the compound having an amino group, for example, there can be used a compound having a primary or secondary amino group, such as triethylenetetramine or diethylenetriamine; a compound having a tertiary amino group, e.g., an N-alkyldialkanolamine, such as N-methyldiethanolamine or N-ethyldiethanolamine, or an N-alkyldiaminoalkylamine, such as N-methyldiaminoethylamine or N-ethyldiaminoethylamine; or the like. These compounds may be used individually or in combination.

As a method for obtaining the urethane resin having a nonionic group, for example, there can be mentioned a method using one or two or more compounds having an oxyethylene structure as a raw material.

As the compound having an oxyethylene structure, for example, polyether polyol having an oxyethylene structure, such as polyoxyethylene glycol, polyoxyethylene polyoxypropylene glycol, or polyoxyethylene polyoxytetramethylene glycol, can be used. These compounds may be used individually or in combination.

As the emulsifying agent which can be used for obtaining the urethane resin forcibly dispersed in the water (B), for example, there can be used a nonionic emulsifying agent, such as polyoxyethylene nonylphenyl ether, polyoxyethylene lauryl ether, polyoxyethylene styrylphenyl ether, polyoxyethylene sorbitol tetraoleate, or a polyoxyethylene-polyoxypropylene copolymer; an anionic emulsifying agent, such as a fatty acid salt, e.g., sodium oleate, or an alkylsulfate salt, an alkylbenzenesulfonic acid salt, an alkylsulfosuccinic acid salt, a naphthalenesulfonic acid salt, a polyoxyethylene alkylsulfuric acid salt, an alkaneslfonate sodium salt, or an alkyl diphenyl ether sulfonic acid sodium salt; a cationic emulsifying agent, such as an alkylamine salt, an alkyltrimethylammonium salt, or an alkyldimethylbenzylammonium salt, or the like. These emulsifying agents may be used individually or in combination.

With respect to the urethane resin (A), from the viewpoint of achieving further more excellent water dispersion stability, hydrolytic resistance, peel strength, prompt releasability, and light resistance, it is preferred that a urethane resin having an anionic group and/or a urethane resin having a nonionic group is used.

From the viewpoint of controlling the concentration of the hydrophilic group of the urethane resin (A) to achieve further more excellent water dispersion stability, hydrolytic resistance, peel strength, prompt releasability, and light resistance, the amount of the raw material used for producing the urethane resin having a hydrophilic group is preferably in the range of from 0.01 to 10% by mass, more preferably in the range of from 0.1 to 5% by mass, based on the total mass of the raw materials constituting the urethane resin (A).

As the polyisocyanate (a1), for example, there can be used an aromatic polyisocyanate, such as phenylene diisocyanate, toluene diisocyanate, diphenylmethane diisocyanate, naphthalene diisocyanate, polymethylene polyphenyl polyisocyanate, or carbodiimidated diphenylmethane polyisocyanate; an aliphatic or alicyclic polyisocyanate, such as hexamethylene diisocyanate, lysine diisocyanate, cyclohexane diisocyanate, isophorone diisocyanate, dicyclohexylmethane diisocyanate, xylylene diisocyanate, tetramethylxylylene diisocyanate, dimer acid diisocyanate, or norbornene diisocyanate, or the like. These polyisocyanates may be used individually or in combination. Of these, from the viewpoint of achieving high intermolecular force and further more excellent peel strength and easily controlling the viscosity of the urethane resin (A) to be in a preferred range, an aromatic polyisocyanate is preferred, and toluene diisocyanate and/or diphenylmethane diisocyanate is more preferred.

As the polyol (a2), for example, polyether polyol, polyester polyol, polycarbonate polyol, dimer diol, acrylic polyol, polybutadiene polyol, or the like can be used. These polyols may be used individually or in combination. Of these, from the viewpoint of further improving the water dispersion stability, hydrolytic resistance, peel strength, prompt releasability, and light resistance, polyether polyol and/or polycarbonate polyol is preferred, and polytetramethylene glycol and/or polycarbonate polyol is more preferred.

From the viewpoint of achieving further more excellent peel strength, mechanical strength of the film, and hydrolytic resistance, the polyol (a2) preferably has a number average molecular weight in the range of from 500 to 10,000, more preferably in the range of from 800 to 5,000. The number average molecular weight of the polyol (a2) indicates a value as measured by a gel permeation chromatography (GPC) method.

A chain extender (a3) (which does not have a carboxyl group and a sulfonyl group, and which has a molecular weight of 50 to less than 500) may be used if necessary in combination with the polyol (a2). As the chain extender, for example, a chain extender having a hydroxyl group, a chain extender having an amino group, or the like can be used. These may be used individually or in combination.

As the chain extender having a hydroxyl group, for example, there can be used an aliphatic polyol compound, such as ethylene glycol, diethylene glycol, triethylene glycol, propylene glycol, 1,3-propanediol, 1,3-butanediol, 1,4-butanediol, hexamethylene glycol, saccharose, methylene glycol, glycerol, or sorbitol; an aromatic polyol compound, such as bisphenol A, 4,4'-dihydroxydiphenyl, 4,4'-dihydroxydiphenyl ether, 4,4'-dihydroxydiphenyl sulfone, hydrogenated bisphenol A, or hydroquinone; water, or the like. These chain extenders may be used individually or in combination.

As the chain extender having an amino group, for example, there can be used ethylenediamine, 1,2-propanediamine, 1,6-hexamethylenediamine, piperazine, 2-methylpiperazine, 2,5-dimethylpiperazine, isophorone diamine, 4,4'-dicyclohexylmethanediamine, 3,3'-dimethyl-4,4'-dicyclohexylmethanediamine, 1,2-cyclohexanediamine, 1,4-cyclohexanediamine, aminoethylethanolamine, hydrazine, diethylenetriamine, triethylenetetramine, or the like. These chain extenders may be used individually or in combination.

When the chain extender (a3) is used, from the viewpoint of further improving the durability of the film, the amount of the chain extender (a3) used is preferably in the range of from 0.5 to 40% by mass, more preferably in the range of from 1 to 20% by mass, based on the total mass of the raw materials constituting the urethane resin (A).

With respect to the method for producing the urethane resin (A), for example, there can be mentioned a method in which the raw material used for producing the urethane resin having a hydrophilic group, the aromatic polyisocyanate (a1), the polyol (a2), and, if necessary, the chain extender (a3) are charged at the same time and subjected to reaction. There can be mentioned a method in which the reaction is conducted, for example, at a temperature of 50 to 100° C. for 3 to 10 hours.

The molar ratio of the isocyanate group of the aromatic polyisocyanate (a1) to the total of the hydroxyl group and amino group of the polyol (a2) and the raw material used for producing the urethane resin having a hydrophilic group and the chain extender (a3) if used [(isocyanate group)/(total of hydroxyl group and amino group)] is preferably in the range of from 0.8 to 1.2, more preferably in the range of from 0.9 to 1.1.

In producing the urethane resin (A), it is preferred that the isocyanate group remaining in the urethane resin (A) is deactivated. When deactivating the isocyanate group, an alcohol having a hydroxyl group, such as methanol, is preferably used. The amount of the alcohol used is preferably in the range of from 0.001 to 10 parts by mass, relative to 100 parts by mass of the urethane resin (A).

Further, when producing the urethane resin (A), an organic solvent may be used. As the organic solvent, for example, there can be used a ketone compound, such as acetone or methyl ethyl ketone; an ether compound, such as tetrahydrofuran or dioxane; an acetate compound, such as ethyl acetate or butyl acetate; a nitrile compound, such as acetonitrile; an amide compound, such as dimethylformamide or N-methylpyrrolidone, or the like. These organic solvents may be used individually or in combination. It is preferred that the organic solvent is removed by a distillation method or the like when obtaining the urethane resin composition.

As the water (B), for example, ion-exchanged water, distilled water, tap water, or the like can be used. Of these, ion-exchanged water having less impurities is preferably used. From the viewpoint of the working properties, application properties, and storage stability, the amount of the water (B) contained is preferably in the range of from 20 to 90% by mass, more preferably in the range of from 40 to 80% by mass, based on the mass of the urethane resin water dispersion.

As the crosslinking agent (C), for example, a carbodiimide crosslinking agent, a polyisocyanate crosslinking agent, a melamine crosslinking agent, an epoxy crosslinking agent, or the like can be used. Of these, from the viewpoint of achieving further more excellent anti-soaking property, a polyisocyanate crosslinking agent is preferred.

The amount of the crosslinking agent (C) used is, for example, in the range of from 1 to 15 parts by mass, relative to 100 parts by mass of the urethane resin (A).

The urethane resin water dispersion of the invention contains the above-mentioned urethane resin (A), water (B), and crosslinking agent (C) as essential components, but may contain an additional additive if necessary.

With respect to the additional additive, for example, there can be used a urethane-forming reaction catalyst, a neutralizing agent, a crosslinking agent, a silane coupling agent, a thickener, a filler, a thixotropic agent, a tackifier, a wax, a heat stabilizer, a light stabilizer, a fluorescent brightener, a foaming agent, a pigment, a dye, an electrical conductivity imparting agent, an antistatic agent, a moisture permeability improver, a water repellent, an oil repellent, a hollow foam, a flame retardant, a water absorbent, a moisture absorbent, a deodorant, a foam stabilizer, an anti-blocking agent, a hydrolysis preventing agent, and the like. These additives may be used individually or in combination.

As mentioned above, the urethane resin water dispersion of the invention contains water and is environment-friendly. Further, the urethane resin water dispersion is unlikely to soak the substrate well and has excellent peel strength and excellent prompt releasability. Therefore, the urethane resin water dispersion can be advantageously used as a material for forming a bonding layer for synthetic leather.

The synthetic leather of the present invention is described below. The synthetic leather is a synthetic leather having at least a substrate (i), a bonding layer (ii), and a skin layer (iii), wherein the bonding layer (ii) is formed from the above-described urethane resin water dispersion.

As the substrate (i), for example, there can be used nonwoven fabric, woven fabric, or knitted fabric, each formed from a polyester fiber, a polyethylene fiber, a nylon fiber, an acrylic fiber, a polyurethane fiber, an acetate fiber, a rayon fiber, a polylactic acid fiber, cotton, linen, silk, wool, a glass fiber, a carbon fiber, a mixed fiber thereof, or the like.

The bonding layer (ii) has a thickness, for example, in the range of from 30 to 60 jam.

As a material for forming the skin layer (iii), for example, a known aqueous urethane resin, solvent urethane resin, solventless urethane resin, aqueous acrylic resin, silicone resin, polypropylene resin, polyester resin, or the like can be used. These resins may be used individually or in combination.

The synthetic leather may have formed thereon, if necessary, an intermediate layer, a wet porous layer, a surface treatment layer, or the like, in addition to the above-mentioned layers.

A method for producing the synthetic leather is described below.

The method for producing the synthetic leather preferably has (x) the step of drying water in the urethane resin water dispersion, (y) the step of laminating the dried material on a substrate, and (z) the step of further heating the resultant laminate at 100 to 150° C.

Specifically, a skin layer is formed on release paper, and then (x) the urethane resin water dispersion is applied onto the skin layer, and water is dried to form a dry bonding layer, and (y) the bonding layer is laminated on a substrate, and then (z) heated at 100 to 150° C. for 2 to 30 minutes to completely cure the urethane resin (A) and the crosslinking agent (C), obtaining a synthetic leather having excellent prompt releasability. The method may have the aging step if necessary after the step (z). In the aging step, for example, there can be mentioned a method using hot-air drying, a heated cylinder, or the like.

EXAMPLES

Hereinbelow, the present invention will be described in more detail with reference to the following Examples.

Synthesis Example 1

Into a four-necked flask equipped with a stirrer, a reflux condenser, a thermometer, and a nitrogen gas introducing pipe were charged 500 parts by mass of polytetramethylene glycol (number average molecular weight: 1,000), 15 parts by mass, and 428 parts by mass of methyl ethyl ketone in a nitrogen gas flow, and they were uniformly mixed with each other and then, 117 parts by mass of toluene diisocyanate (hereinafter, abbreviated to "TDI") was added and then 0.1 part by mass of dibutyltin dilaurate was added and the resultant mixture was subjected to reaction at 70° C. for about 4 hours. Then, 11 parts by mass of 1,3-butanediol was added and the resultant mixture was subjected to reaction at 70° C. for about one hour, and the reaction was terminated to obtain a methyl ethyl ketone solution of a urethane polymer. Then, to the methyl ethyl ketone solution of urethane polymer obtained by the above method was added 10 parts by mass of N,N-dimethylethanolamine to neutralize the carboxyl group in the urethane polymer, and then 964 parts by mass of ion-exchanged water was added and then methyl ethyl ketone was distilled off under a reduced pressure to obtain a urethane resin water dispersion (U-1) (nonvolatile content: 40% by mass; weight average molecular weight: 55,000).

Synthesis Example 2

In a four-necked flask equipped with a stirrer, a reflux condenser, a thermometer, and a nitrogen gas introducing pipe, 1,000 parts by mass of polycarbonate polyol ("NIPPOLAN 980R", manufactured by Nippon Polyurethane Industry Co., Ltd.; number average molecular weight: 2,000), 17 parts by mass of DMPA, 47 parts by mass of ethylene glycol, and 344 parts by mass of diphenylmethane diisocyanate (hereinafter, abbreviated to "MDI") were subjected to reaction at 70° C. in the presence of 3,281 parts by mass of methyl ethyl ketone and 0.1 part by mass of tin(II) octylate in a nitrogen gas flow until the solution viscosity reached 20,000 mPa·s, and then 3 parts by mass of methanol was added to terminate the reaction, obtaining a methyl ethyl ketone solution of a urethane resin. Into the obtained urethane resin solution were mixed 70 parts by mass of polyoxyethylene distyrenated phenyl ether (Hydrophile-Lipophile Balance (hereinafter, abbreviated to "HLB"): 14; average addition molar number of oxyethylene group: 10) and 13 parts by mass of triethylamine, and then 800 parts by mass of ion-exchanged water was added to the resultant mixture to cause phase inversion emulsification, obtaining an emulsion having the urethane resin dispersed in water.

Then, methyl ethyl ketone was distilled off from the emulsion to obtain a urethane resin water dispersion (U-2) (nonvolatile content: 40% by mass; weight average molecular weight: 200,000).

Synthesis Example 3

Into a four-necked flask equipped with a stirrer, a reflux condenser, a thermometer, and a nitrogen gas introducing pipe were charged 500 parts by mass of polytetramethylene glycol (number average molecular weight: 1,000), 15 parts by mass, and 428 parts by mass of methyl ethyl ketone in a nitrogen gas flow, and they were uniformly mixed with each other and then, 117 parts by mass of toluene diisocyanate (hereinafter, abbreviated to "TDI") was added and then 0.1 part by mass of dibutyltin dilaurate was added and the resultant mixture was subjected to reaction at 70° C. for about 4 hours. Then, 11 parts by mass of 1,3-butanediol was added and the resultant mixture was subjected to reaction at 70° C. for about one hour, and the reaction was terminated to obtain a methyl ethyl ketone solution of a urethane polymer. Then, to the methyl ethyl ketone solution of urethane polymer obtained by the above method was added 10 parts by mass of N,N-dimethylethanolamine to neutralize the carboxyl group in the urethane polymer, and then 964 parts by mass of ion-exchanged water was added and then methyl ethyl ketone was distilled off under a reduced pressure to obtain a urethane resin water dispersion (U-3) (nonvolatile content: 40% by mass; weight average molecular weight: 113,000).

Examples 1 to 4 and Comparative Examples 1 to 3

<Production of a Synthetic Leather>

A mixture of 100 parts by mass of an aqueous urethane resin composition for a skin layer ("Hydran WLS-250", manufactured by DIC Corporation), 10 parts by mass of a water dispersible black pigment ("Dilac HS-9530", manufactured by DIC Corporation), and 1 part by mass of an associative thickener ("Hydran Assistor T10", manufactured by DIC Corporation) was applied to flat release paper ("DN-TP-155T", manufactured by Ajinomoto Co., Inc.) so that the resultant dried film had a thickness of 30 μm, and dried at 70° C. for 2 minutes and then at 120° C. for 2 minutes.

Then, a mixture of the materials shown in the formulation of Table 1 was applied so that the thickness of the solids became 50 μm, and dried at 70° C. for 3 minutes. The dried material was laminated on T/R raised fabric, and then subjected to heat treatment under conditions at 130° C. for 10 minutes, and the release paper was peeled off to obtain a synthetic leather.

[Method for Measuring a Number Average Molecular Weight and a Weight Average Molecular Weight]

The number average molecular weight of the polyol used in the Examples and Comparative Examples and the weight average molecular weight of the urethane resin are values as measured by a gel permeation chromatography (GPC) method under the conditions shown below.

Measuring apparatus: High-speed GPC apparatus ("HLC-8220GPC", manufactured by Tosoh Corp.)

Columns: The columns shown below, manufactured by Tosoh Corp., which are connected in series were used.

"TSKgel G5000" (7.8 mm I.D.×30 cm)×1
"TSKgel G4000" (7.8 mm I.D.×30 cm)×1
"TSKgel G3000" (7.8 mm I.D.×30 cm)×1
"TSKgel G2000" (7.8 mm I.D.×30 cm)×1

Detector: RI (differential refractometer)

Column temperature: 40° C.

Eluent: Tetrahydrofuran (THF)

Flow rate: 1.0 mL/minute

Sample amount per injection: 100 μL (tetrahydrofuran solution having a sample concentration of 0.4% by mass)

Standard sample: A calibration curve was prepared using the standard polystyrenes shown below.

(Standard Polystyrenes)

"TSKgel standard polystyrene A-500", manufactured by Tosoh Corp.
"TSKgel standard polystyrene A-1000", manufactured by Tosoh Corp.
"TSKgel standard polystyrene A-2500", manufactured by Tosoh Corp.
"TSKgel standard polystyrene A-5000", manufactured by Tosoh Corp.

"TSKgel standard polystyrene F-1", manufactured by Tosoh Corp.

"TSKgel standard polystyrene F-2", manufactured by Tosoh Corp.

"TSKgel standard polystyrene F-4", manufactured by Tosoh Corp.

"TSKgel standard polystyrene F-10", manufactured by Tosoh Corp.

"TSKgel standard polystyrene F-20", manufactured by Tosoh Corp.

"TSKgel standard polystyrene F-40", manufactured by Tosoh Corp.

"TSKgel standard polystyrene F-80", manufactured by Tosoh Corp.

"TSKgel standard polystyrene F-128", manufactured by Tosoh Corp.

"TSKgel standard polystyrene F-288", manufactured by Tosoh Corp.

"TSKgel standard polystyrene F-550", manufactured by Tosoh Corp.

[Method for Measuring a Viscosity of the Urethane Resin (A)]

With respect to the dried material of the urethane resin water dispersion which contains no crosslinking agent, using a rheometer ("MCR-302", manufactured by Anton-Paar GmbH), a viscosity was measured while heating from ordinary room temperature to 150° C. at a temperature change of 5° C./minute.

[Method for Measuring a Peel Strength]

A hot-melt tape having a width of 2.5 cm ("BW-2", manufactured by San Chemicals, Ltd.) was placed on each of the synthetic leathers obtained in the Examples and Comparative Examples, and heated at 150° C. for 3 minutes so that the hot-melt tape was bonded to the synthetic leather. A specimen having the width of the hot-melt tape was cut. A part of the specimen was peeled, and the substrate and the hot-melt tape were held by chucks, and, using Autograph ("AG-1", manufactured by Shimadzu Corporation), a peel strength was measured, and converted to a value per 1 cm width. A specimen having a peel strength of 1 kgf/cm or more was judged to have excellent peel strength.

[Method for Measuring Prompt Releasability]

With respect to the synthetic leather obtained immediately after the preparation, a five-yen coin was placed on the skin layer, and a load of 1 kg was applied onto the coin, and the resultant synthetic leather was allowed to stand overnight, and then the load and the five-yen coin were removed, and the surface of the synthetic leather was observed, and evaluated according to the following criteria.

"T": The pattern of the five-yen coin is not found.

"F": The pattern of the five-yen coin is found.

[Evaluation Method for Anti-Soaking Property]

1. Evaluation by Means of an Electron Microscope

A cross-section of a synthetic leather was observed using an electron microscope (scanning electron microscope "SU3500", manufactured by Hitachi High-Tech Corporation; magnification: 200 times), and evaluated according to the following criteria.

"T": The synthetic leather has a bonding layer, and part of the bonding layer has soaked the substrate.

"F": All the bonding layer has soaked the substrate, or the bonding layer has not soaked the substrate at all.

2. Evaluation by Flexing

A synthetic leather was subjected to flexing test using a flexometer under conditions at 25° C. with 100,000 flexings, and evaluated according to the following criteria.

"T": The synthetic leather has no breakage.

"F": The synthetic leather breaks.

TABLE 1

| Table 1 | Example 1 | Example 2 | Example 3 | Example 4 | Comparative Example 1 | Comparative Example 2 | Comparative Example 3 |
|---|---|---|---|---|---|---|---|
| Formulation | | | | | | | |
| (U-1) | 90 | 80 | 70 | | 100 | 50 | |
| (U-2) | 10 | 20 | 30 | | | 50 | 100 |
| (U-3) | | | | 100 | | | |
| Thickener 1 | 5 | 5 | 5 | 5 | 5 | 5 | 5 |
| Crosslinking agent 1 | 9 | 9 | 9 | 9 | 9 | 9 | 9 |
| Urethane resin (A) | | | | | | | |
| Viscosity at 50° C. (mPa * s) | 15400 | 26300 | 28900 | 32000 | 8500 | 34700 | 108000 |
| Viscosity at 100° C. (mPa * s) | 333 | 2420 | 4010 | 6250 | 152 | 10000 | 18830 |
| Viscosity at 150° C. (mPa * s) | 76 | 204 | 373 | 751 | 35 | 1420 | 6300 |
| Evaluation of anti-soaking property | | | | | | | |
| 1. Evaluation by electron microscope | T | T | T | T | F | F | F |
| 2. Evaluation by flexing | T | T | T | T | F | T | T |
| Evaluation of peel strength (kgf/cm) | 1.5 | 1.5 | 1.5 | 1.5 | 0.1 | 0.3 | 0.1 |
| Evaluation of prompt releasability | T | T | T | T | T | T | T |

The abbreviations shown in Table 1 are as follows.

"Thickener 1": Associative thickener ("Hydran Assistor T10", manufactured by DIC Corporation)

"Crosslinking agent 1": Polyisocyanate crosslinking agent ("Hydran Assistor C5", manufactured by DIC Corporation)

In Examples 1 to 4 which correspond to the urethane resin water dispersion of the present invention, it was found that the urethane resin water dispersion was unlikely to soak the substrate well and had excellent peel strength and excellent prompt releasability.

On the other hand, in Comparative Example 1 which corresponds to an embodiment in which the viscosity at 50° C. of the urethane resin (A) is smaller than the range defined in the present invention, the urethane resin soaked the substrate to such a large extent that the peel strength was poor.

In Comparative Example 2 which corresponds to an embodiment in which the viscosity at 150° C. of the urethane resin (A) is larger than the range defined in the present invention, the urethane resin soaked the substrate to such a small extent that the peel strength was poor.

In Comparative Example 3 which corresponds to an embodiment in which the viscosity at 150° C. of the urethane resin (A) is larger than the range defined in the present invention, the urethane resin soaked the substrate to such a small extent that the peel strength was poor.

The invention claimed is:

1. A urethane resin water dispersion containing a urethane resin (A), water (B), a crosslinking agent (C), and a nonionic emulsifying agent, wherein the urethane resin (A) is obtained from reactants comprising a polytetramethylene glycol and/or polycarbonate polyol reactant, and a diphenylmethane diisocyanate reactant, wherein the urethane resin (A) has a viscosity at 50° C. in the range of from 15,000 to 34,000 mPa·s, a viscosity at 100° C. in the range of from 1,000 to 10,000 mPa·s, and a viscosity at 150° C. in the range of from 100 to 1,300 mPa·s, and wherein the viscosity is measured using a rheometer while heating from room temperature to 150° C. at a temperature change of 5° C./minute.

2. The urethane resin water dispersion according to claim 1, wherein the urethane resin (A) is a urethane resin having an anionic group and/or a urethane resin having a nonionic group.

3. A synthetic leather having at least a substrate (i), a bonding layer (ii), and a skin layer (iii), wherein the bonding layer (ii) is formed from the urethane resin water dispersion according to claim 2.

4. A method for producing a synthetic leather, having (x) the step of drying water in the urethane resin water dispersion according to claim 2, (y) the step of laminating the dried material on a substrate, and (z) the step of further heating the resultant laminate at 100 to 150° C.

5. A synthetic leather having at least a substrate (i), a bonding layer (ii), and a skin layer (iii), wherein the bonding layer (ii) is formed from the urethane resin water dispersion according to claim 1.

6. A method for producing a synthetic leather, having (x) the step of drying water in the urethane resin water dispersion according to claim 1, (y) the step of laminating the dried material on a substrate, and (z) the step of further heating the resultant laminate at 100 to 150° C.

* * * * *